United States Patent [19]

Bergmann et al.

[11] Patent Number: 5,042,718

[45] Date of Patent: Aug. 27, 1991

[54] SOLENOID-VALVE-CONTROLLED FUEL INJECTION DEVICE, FOR AN AIR-COMPRESSING INTERNAL COMBUSTION ENGINE

[75] Inventors: Horst Bergmann; Emil Bauerle, both of Esslingen, Fed. Rep. of Germany

[73] Assignee: Daimler-Benz AG, Fed. Rep. of Germany

[21] Appl. No.: 430,124

[22] Filed: Nov. 1, 1989

[30] Foreign Application Priority Data

Nov. 10, 1988 [DE] Fed. Rep. of Germany ..... 3838147

[51] Int. Cl.[5] ..... F02M 47/00

[52] U.S. Cl. ..... 239/88; 239/124; 239/585

[58] Field of Search ..... 239/88, 90, 91, 124, 239/127, 585

[56] References Cited

U.S. PATENT DOCUMENTS

| | | | |
|---|---|---|---|
| 4,211,202 | 7/1980 | Hafner | 239/88 |
| 4,402,456 | 9/1983 | Schneider | 239/90 |
| 4,482,094 | 11/1984 | Knape | 239/88 |
| 4,526,519 | 7/1985 | Mowbray et al. | 239/88 |
| 4,540,122 | 9/1985 | Teerman | 239/88 |
| 4,568,021 | 2/1986 | Deckard et al. | 239/88 |
| 4,741,478 | 5/1988 | Teerman et al. | 239/88 |
| 4,811,899 | 3/1989 | Egler | 239/90 |

FOREIGN PATENT DOCUMENTS

| | | |
|---|---|---|
| 2742466 | 3/1979 | Fed. Rep. of Germany . |
| 3328089 | 2/1984 | Fed. Rep. of Germany . |
| 3707731 | 9/1988 | Fed. Rep. of Germany . |

*Primary Examiner*—Andres Kashnikow
*Assistant Examiner*—Michael J. Forman
*Attorney, Agent, or Firm*—Evenson, Wands, Edwards, Lenahan & McKeown

[57] ABSTRACT

The invention relates to a solenoid-valve-controlled injection device, comprising pump and nozzle, for an air-compressing internal combustion engine having an electromagnetically actuatable control valve. The valve stem of the control valve co-operates with a control slide which is designed as an inertia piston and, via its control bore and a bore arrangement in the valve stem, establishes a connection between a fuel injection line leading to the nozzle and a return line in order to divide the injection into a temporally staggered pre- and main injection.

11 Claims, 3 Drawing Sheets

2
4
24
27
25
7
6
5
1
26
10
23
3

SOLENOID-VALVE-CONTROLLED FUEL INJECTION DEVICE, FOR AN AIR-COMPRESSING INTERNAL COMBUSTION ENGINE

BACKGROUND AND SUMMARY OF THE INVENTION

The invention relates to a solenoid-valve-controlled fuel injection device, comprising pump and nozzle, for an air-compressing internal combustion engine having a mechanically actuated pump plunger and a pump working space which is bounded by the latter and is in constant communication with a fuel injection line leading to the nozzle, furthermore having an electromagnet, the latter having a stem-like control valve, for controlling a connection of the fuel injection line to a return line for the initiation and ending of injection.

DE 2,742,466 C 2 discloses a solenoid-valve-controlled fuel injection device of this kind in which the beginning of injection and the end of injection are controlled by means of an electromagnet having a control valve for blocking the fuel return and of a control side which interrupts the advance of the fuel to the nozzle needle.

The control valve used here is a pilot valve by which the control slide controlling the advance of the fuel is subsequently influenced. When the fuel feed is completely closed off by the control slide, the fuel delivered is injected at high pump pressure via the nozzle needle lifting off from the valve seat. The end of injection is initiated by opening the pilot valve following discontinuation of the excitation of the electromagnet and simultaneous opening of the control slide.

With a fuel injection device of this type it is virtually impossible to avoid troublesome, harsh combustion noises.

It is therefore an object of the present invention to achieve a reduction of the combustion noises by simple constructional measures on a solenoid-valve controlled fuel injection device comprising pump and nozzle.

This object is achieved by providing an arrangement wherein a control slide acting as inertia piston is guided rotationally fast and so as to be longitudinally displaceable counter to the force of a restoring spring on the valve stem of the control valve and has a control bore via which and via a bore arrangement in the valve stem of the control valve the fuel injection line can be connected to the return line within an injection phase.

Through the use of an inertia piston which is guided slidingly on the control valve of an electromagnet and establishes a connection of the injection line to the fuel return and thus briefly interrupts the injection during one operating cycle per engine cylinder, the injection is divided into a pre- and a main injection. The pre-injection here is a measure to reduce considerably the loud combustion noises occurring in diesel engines. Up to the inertia piston taking effect, a small part of the injection quantity is injected into the combustion chamber and after a very short pause in injection - as soon as the inertia piston is inoperative the remaining principal part of the injection quantity is injected.

Although the division of the injection into a temporally pre- and main injection is known from DE 3,757,731 A1, the discussion there is of a pump in the form of a distributor-type injection pump having a distributor plunger executing rotary and reciprocating movements. The metering of small pre-injection quantities, in particular at high speeds, is problematic, since the combustion chambers of all the cylinders of the internal combustion engine have to be supplied during one rotation of the distributor plunger. The switching times of the solenoid valve must be very short. Also disadvantageous is the ever-increasing interval between pre- and main injection - in terms of crank angle degrees - with increasing speed.

Other objects, advantages and novel features of the present invention will become apparent from the following detailed description of the invention when considered in conjunction with the accompanying drawings.

DETAILED DESCRIPTION OF THE DRAWINGS

Figure 1:
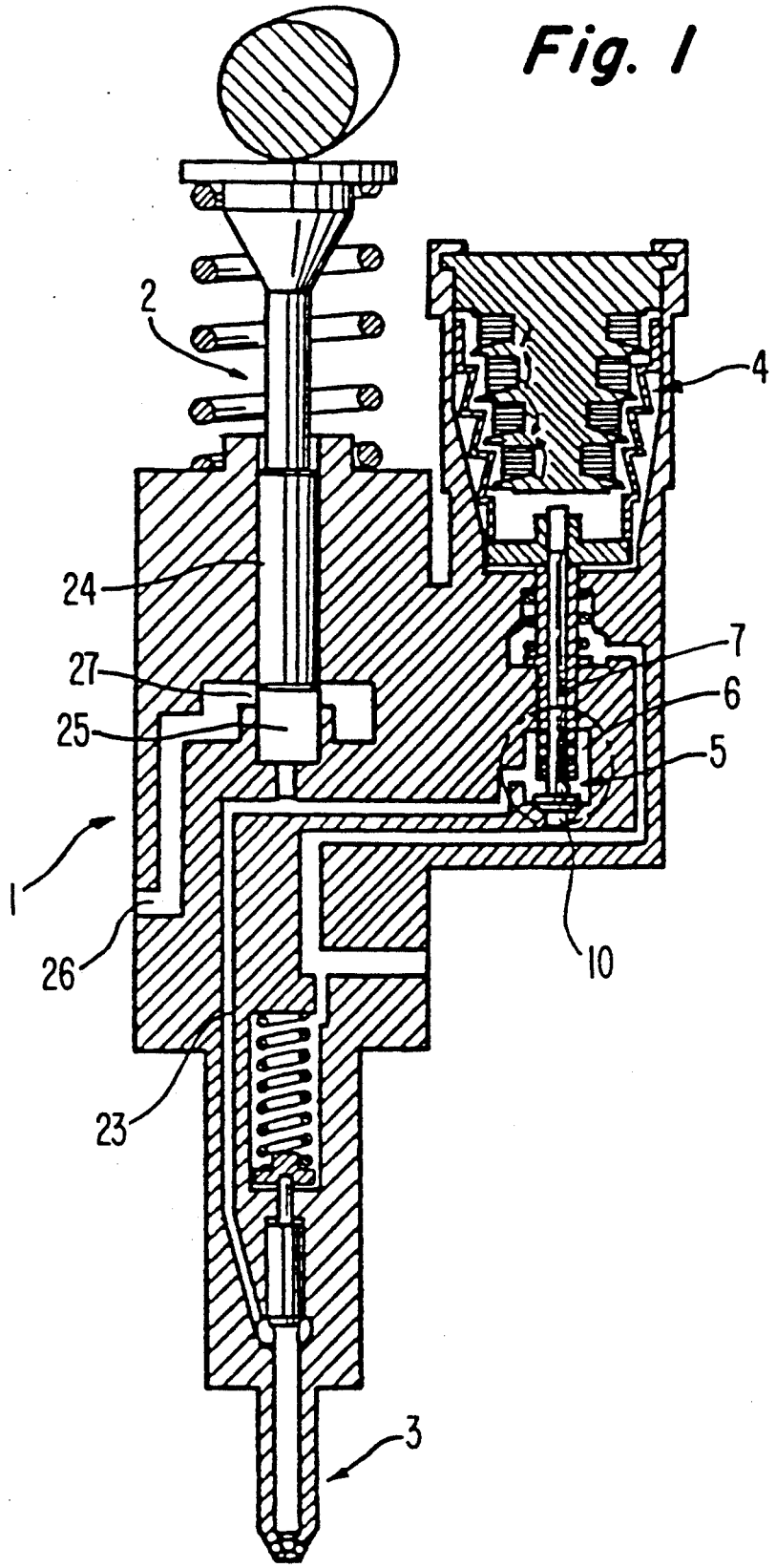
FIG. 1 shows a longitudinal section through a pump, nozzle and solenoid valve combined to form a single constructional unit constructed according to preferred embodiments of invention.

A solenoid-valve controlled injection device 1, shown in FIG. 1, for air-compressing self-igniting internal combustion engines essentially comprises a pump 2 and nozzle 3 and an electromagnet 4 which are combined to form a single constructional unit. The electromagnet 4 has a control valve 5 which is of stem-like design and whose valve stem 7, which protrudes into a control space 6, is shaped at the free end to form a valve head 8 which controls the opening 9 of a return line 10 which leads away from the control space 6 and communicates with a fuel tank (not shown). A control slide 11 which surrounds the valve stem 7, is secured against rotation and is guided on said valve stem 7 so as to be longitudinally displaceable counter to a restoring spring 12. In its starting position, the control slide 11 rests under spring pre-stress against a widened part 13 of the valve stem 7, which is guided in the housing 14 of the constructional unit.

Control slide 11 is referred to herein as operating as an "inertia piston." this terminology refers to the fact that, as valve stem 7 moves downward, as described hereinbelow, control slide 11, which is slidably mounted thereon, moves with it. When, however, the downward motion of the vale stem 11 is abruptly halted as it strikes valve seat 28, the inertia of control slide 11 counteracts the force of spring 12 and causes control slide 11 to continue its downward movement, sliding along valve stem 7 until it bottoms out against valve head 8. This movement is depicted in sequence in FIGS. 2, 3 and 4. The function of the control slide is described hereinbelow.

In the control space 6 of elongate design, the valve stem 7 comprises two sections 15 and 16, which have diameters of different size and of which the upper section 16, which faces the widened part 13, adjoins the lower section 15 with the formation of a step 17 which recedes inwards towards the longitudinal axis of the valve stem.

The control slide 11, slidingly guided on section 15, is provided at its upper end with an internal collar 18 which serves as a support for the restoring spring 12 arranged in the annular space 19 formed by control slide 11 and section 16, said spring being supported at the opposite end on the step 17.

Section 15 contains a bore arrangement which comprises a blind bore 20 extending centrally in the valve stem 7 and a radial bore 21 intersecting the blind bore. A radial bore is Provided in the control slide 11 as control bore 22 and co-operates with the radial bore 21 to produce an interruption of injection and establishes the connection of a fuel injection line 23 leading to the nozzle with the return line 10. The fuel injection line 23 opens laterally into the elongate control space 6 and is continuously connected to a pump working space 25 bounded by a mechanically actuated pump plunger 24.

Figure 4:
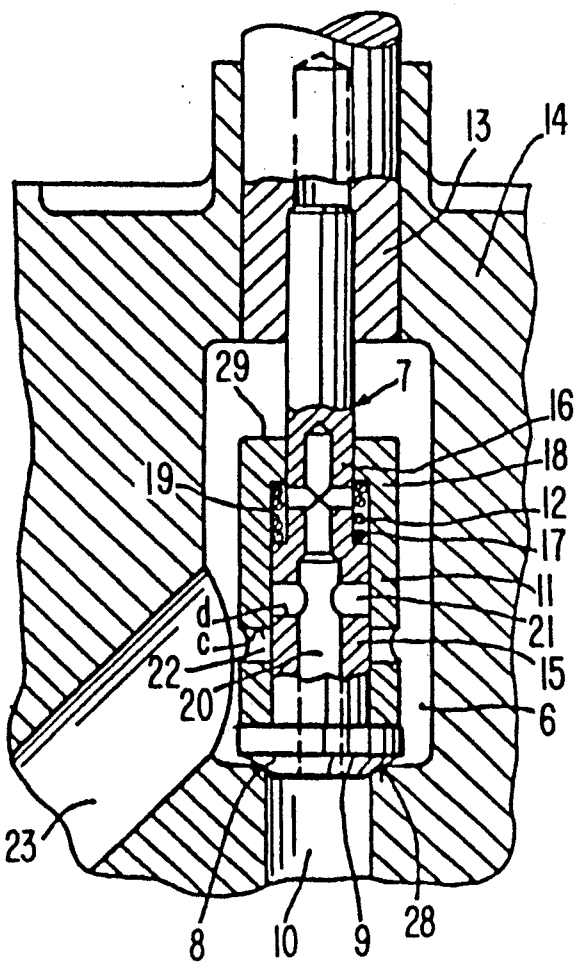
FIGS. 2 to 4 show, in enlarged representation, a detail from FIG. 1 which shows the inertia piston in various positions.
Figure 3:
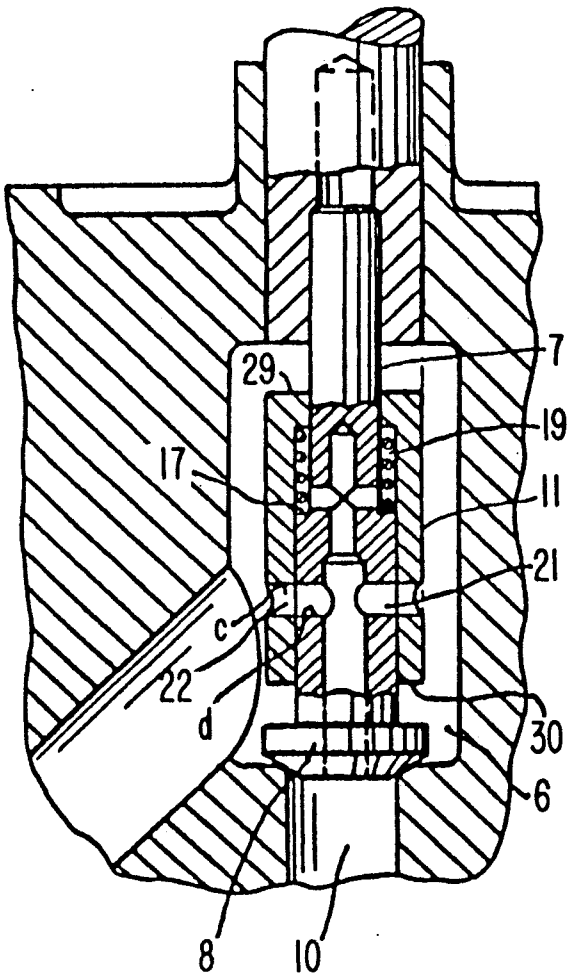
Figure 2:
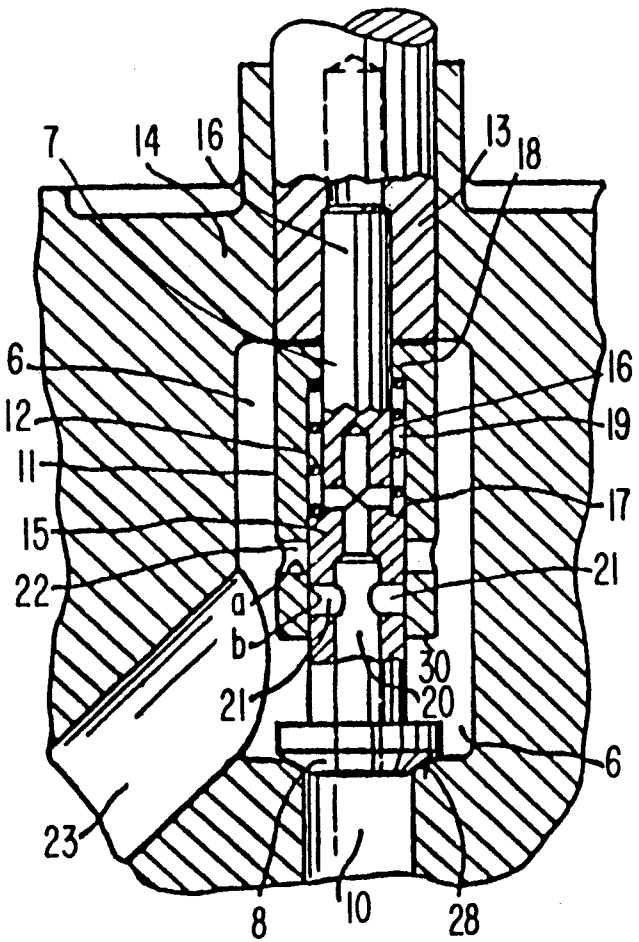
Figure 5:
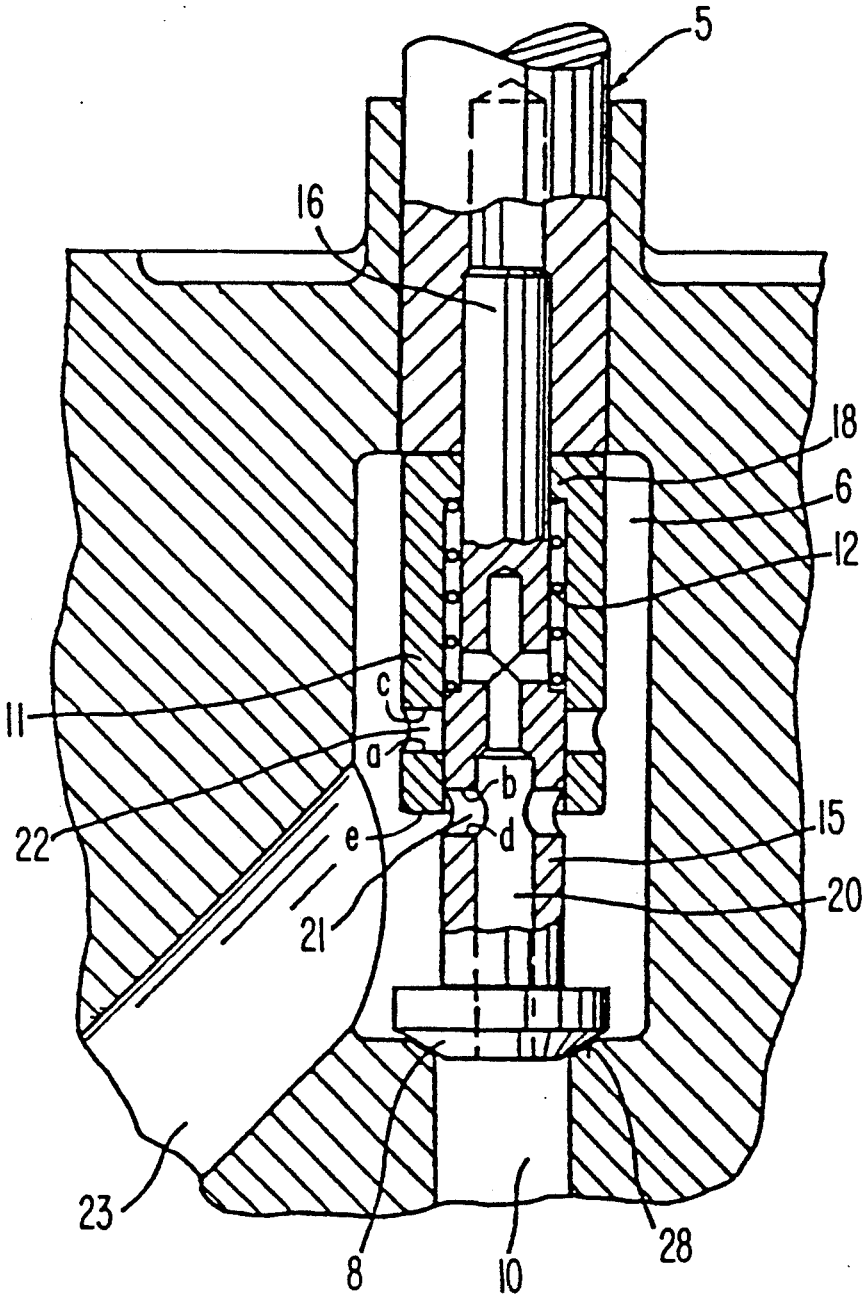
FIG. 5 shows the inertia piston in normal position with an overflow bore.

FIG. 5 shows an embodiment deviating from FIGS. 2 to 4, in which the radial bore 21 in the valve stem 7 is simultaneously an overflow bore, said bore being positioned such that it is effective up to the closure of the return line 10. The overflow bore is advantageous for metering small injection quantities at high speeds.

Functioning of the solenoid-valve-controlled pump-nozzle is as follows:

The fuel, delivered at a pressure of about 4 bar, passes via the feed line 26 and a control bore 27 opened by the pump plunger 24 into the pump working space 25 and from there into the fuel injection line, into the control space 6 and, when the control valve 5 is open, into the return line 10 and finally into the fuel tank.

As soon as the mechanically actuated pump plunger 24 shuts off or closes the control bore 27 on the downward stroke and the control valve 5 of the electromagnet 4 controlled by a control pulse is then brought into the closing position, the connection between fuel injection line 23 and return line 10 is interrupted and pre-injection begins (FIG. 2). At the same time, the rapid deceleration of the control valve 5, which strikes against the valve seat 28 formed by the return line 10, causes the control slide 11, designed as an inertia piston, to come away from its upper stop and accelerate in the direction of the lower stop which is formed by the valve head 8. In the interim, the control edge "a" of the control bore 22 passes over the control edge "b" of the radial bore 21, the control space 6 is abruptly relieved by the flowing off of the fuel and pre-injection is at an end (FIG. 3).

The control slide 11 moves on, controlled edges "c" and "d" come into overlap, the pressure is built up again and main injection begins (FIG. 4). The inertia piston strikes against the valve head 8. Control valve 5 is subsequently opened by activation of the electromagnet 4, the pressure in injection line 23 thereby being relieved via return line 10, main injection is at an end. The inertia piston, (assisted by the opening of control valve 5) is simultaneously brought by the restoring spring 12 up against the upper stop.

The pre-injection quantity is determined by the spacing of the control edges "a" and "b" and the velocity of the inertia piston, said velocity being composed of the touch-down velocity of the control valve 5 on to the valve seat 28 and the velocity produced by the larger effective surface on the inertia piston.

The temporal interval between the end of pre-injection and the beginning of main injection is determined by the spacing of the control edges "c" and "d" and the velocity of the inertia piston. By appropriate dimensioning of the upper and lower stop faces 29, 30 of the inertia piston on which the injection pressure acts and by the speed-dependence of the injection pressure, it is possible to influence in a desired manner the pre-injection quantity and the interval between pre- and main injection as a function of the engine speed. Thus, the differential pressure resulting from the differently sized stop faces can be utilized to the effect that the increasing interval between pre- and main injection is counteracted as the speed increases.

In the embodiment according to FIG. 5, fuel can flow through the open cross-section between the control edges e and d into the return line 10 during the closure phase of the control valve 5. As a result, the closure phase of the control valve 5 has no influence on the injection process. However, as soon as the control edges c and d overlap by virtue of the downward-moving inertia piston 11, pre-injection begins. The further progress of pre- and main injection corresponds to the embodiment initially described (FIGS. 2 to 4).

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A solenoid-valve-controlled injection device for an air-compressing internal-combustion engine, comprising a pump and a nozzle, a mechanically actuated pump plunger, an enclosed pump working space which is bounded on one surface thereof by said pump plunger and is in constant communication with a fuel injection line leading to said nozzle, a fuel supply line leading from a fuel supply to said pump working space, said fuel injection line being selectively connected by an electromagnetically operated control valve to a fuel return line; said control valve having an elongated valve stem and a valve head adapted to close off a first connection of said fuel injection line to said return line upon engagement of said valve head with said return line, a sleeve surrounding said valve stem and being longitudinally and non-rotatably displaceable thereon against the force of a restoring spring, said valve stem having a bore arrangement therein which constantly communicates with said return line, said sleeve having a control bore therein which constantly communicates with said fuel injection line, and said sleeve acting as an inertia piston by moving with said valve stem and being displaced longitudinally thereon upon engagement of said valve head with said return line, whereby said control bore momentarily communicates with said bore arrangement during said longitudinal displacement and reduces pressure in said fuel injection line during an injection phase.

2. Injection device according to claim 1, wherein said valve head is formed on a valve seat end of said valve stem, is adapted to close off said first connection of said fuel injection line with said return line during said injection phase, and is adapted to act as a lower stop for said inertia piston.

3. Injection device according to claim 2, wherein said valve stem comprises an upper and lower section, said lower section being between said upper section and said valve head, and having a diameter which is greater than that of said upper section, the junction of said lower section to said upper section forming a step which recedes inwards towards the longitudinal axis of the valve stem.

4. Injection device according to claim 3, wherein said inertia piston has an internal collar guided on the upper section of the valve stem, while a lower part of the inertia piston is mounted on the lower section of the valve stem, and wherein the restoring spring is arranged under pre-stress in an annular space between said inertia piston and valve stem and is supported on one end on the internal collar and on the other end on the step.

5. Injection device according to claim 1, wherein said valve stem comprises an upper and lower section, said lower section being between said upper section and said valve head, and having a diameter which is greater than that of said upper section, the junction of said lower section to said upper section forming a step which recedes inwards the longitudinal axis of the valve stem.

6. Injection device according to claim 5, wherein said inertia piston has an internal collar guided on the upper section of the valve stem, while a lower part of the inertia piston is mounted on the lower section of the valve stem, and wherein the restoring spring is arranged under pre-stess in an annular space between said inertia piston and valve stem and is supported on one end on the internal collar and on the other end on said step.

7. Injection device according to claim 1, wherein the bore arrangement in the valve stem is composed of a centrally extending blind bore which communicates constantly with said fuel return line, and at least one radial bore which intersects with said blind bore and is adapted to align with the control bore in the inertia piston when said inertia piston is displaced to a predetermined position on said valve stem, said control bore likewise being designed as a radial bore, whereby alignment of said control bore with said radial bore effects a connection between said fuel injection line and said return line.

8. Injection device according to claim 7, wherein a face of the inertia piston which faces the valve seat is smaller than a face of the inertia piston facing away from the valve seat.

9. Injection device according to claim 8, wherein the radial bore in the valve stem is adapted to connect said fuel injection line to said return line prior to any displacement of said inertia piston against said restoring spring.

10. Injection device according to claim 7, wherein the radial bore in the valve stem is adapted to connect said fuel injection line to said return line prior to any displacement of said inertia piston against said restoring spring.

11. Injection device according to claim 1, wherein a face of the inertia piston which faces the valve seat is smaller than a face of the inertia piston facing away from the valve seat.

* * * * *